United States Patent [19]

Friedrich

[11] 4,007,307

[45] Feb. 8, 1977

[54] ARTIFICIAL LAWN

[75] Inventor: Hans-Joachim Friedrich, Backnang, Germany

[73] Assignee: J. F. Adolff AG, Backnang, Germany

[22] Filed: June 25, 1974

[21] Appl. No.: 483,062

Related U.S. Application Data

[63] Continuation of Ser. No. 189,635, Oct. 15, 1971, abandoned.

[30] Foreign Application Priority Data

Oct. 17, 1970 Germany ..... 5110842

[52] U.S. Cl. ..... 428/17; 273/33; 428/95; 428/311; 428/314; 428/315

[51] Int. Cl.[2] ..... A01N 3/00; A41G 1/00

[58] Field of Search ..... 161/62–67, 161/88, 159, 21; 273/33; 117/7, 11, 37 R, 44; 404/2; 428/17, 95, 311, 314, 315

[56] References Cited

UNITED STATES PATENTS

| | | | |
|---|---|---|---|
| 2,515,847 | 7/1950 | Winkler | 161/64 |
| 3,661,687 | 5/1972 | Spinney | 161/21 |

*Primary Examiner*—Marion E. McCamish

[57] ABSTRACT

An artificial lawn comprising a base textile fabric, woven or knit with an open weave to which the pile yarns are secured; the fabric back is formed with projections extending from the plane thereof. The base fabric is coated with an adhesive, holding material solely along the projections, leaving the open weave porous for drainage of water. A novel underliner or underlayer is provided having enhanced resiliency and improved porosity. An improved method and apparatus for securing the lawn to the ground is provided.

22 Claims, 10 Drawing Figures

INVENTOR.
HANS-JOACHIM FRIEDRICH
BY
Murray Schaffer
Atty

INVENTOR.
HANS-JOACHIM FRIEDRICH
BY
Thomas Schaffer Atty.

INVENTOR.
HANS-JOACHIM FRIEDRICH
BY
Thomas Schaffer Atty

INVENTOR.
HANS-JOACHIM FRIEDRICH
BY
Thomas Schaff Atty

INVENTOR.
HANS-JOACHIM FRIEDRICH
BY
Thomas Schaffer Atty

INVENTOR.
HANS-JOACHIM FRIEDRICH
BY
Thuring Schaffer Atty

ARTIFICIAL LAWN

This is a Continuation Application of Ser. No. 189,635, filed Oct. 15, 1971, now abandoned.

BACKGROUND OF DISCLOSURE

This invention relates to a water permeable artificial lawn and particularly to an artificial turf surface for playing fields.

As is well known a natural lawn which is intended to be used as a game or playing surface for "outdoor" sports presents various difficulties resulting from changing climatic conditions. Excessive dryness destroys the lawn's surface and makes its maintenance costly and complex. Excessive rain softens the grass surface and makes it unfit for play or causes its destruction when a game is played on it. Moreover, a natural lawn used by professional sport teams may be used for only a limited number of consecutive games in order to keep it in good condition. Even lawns on which few games are played under relatively favorable climatic conditions show uneven wear so that it must be periodically renewed from the bottom up. In order to remedy the aforedescribed problems various artificial types of lawns have been developed by which it should be theoretically possible to play in any season, independent of the weather, not only two or at the most three days a week but without interruption.

However, it is a disadvantage of the known artificial lawns as for example, those described in U.S. Pat. Nos. 3,332,828, German Published Application DOS 1,933,048, and German Utility Model Patent 6,914,675 that they cannot be played upon after a rain because the residual liquid is released too slowly and then not completely. This disadvantage is due to the fact that the fibers which form the pile of the lawn are held together by a very dense base fabric or by a non-porous layer applied to the entire surface of the back of base fabric. Such layers normally consist of synthetic material such as polyvinyl chloride or a rubberlike mass which, in either case, makes the lawn impermeable to water or makes the fabric entirely waterproof.

It has also been proposed, for example, in the German Published Application DOS 1,534,383 to make an artificial lawn water permeable by making the base fabric of otherwise impermeable materials which can be perforated during or after drying by means of needles of suitable thickness. In such artificial lawns, however, it is difficult to maintain a secure anchorage of pile fibers in spite of the perforation of the materials. On the other hand mere water permeability of the base fabric does not produce the desired release of the water unless a very highly water permeable layer is provided below the base fabric since the water would only enter the holes in the fabric but would not find its way out. This occurs, because the known base fabrics are completely flat on their underside and thus prevent water which had passed through the holes or openings of the base fabric to flow away.

It is the object of the present invention to provide an artificial lawn or turf overcoming the disadvantages of the prior art.

It is another object of the present invention to provide an artificial lawn wholly permeable to water while simultaneously insuring that the pile yarns forming the surface are firmly held in the base fabric.

It is another object of the present invention to provide an artificial lawn having a basic carrier which permits the safe release of the water from its underside.

It is another object of the present invention to provide an artificial lawn which may be easily installed and which may be maintained in proper stretched and playing condition.

It is another object of the present invention to provide an artificial lawn playable in all seasons.

These and other objects together with numerous advantages will be apparent from the following disclosure.

SUMMARY OF THE INVENTION

According to the present invention an artificial lawn is formed comprising a base textile fabric, woven or knit with an open weave to which the pile yarns are secured; the fabric back formed with projections extending from the plane thereof. The base fabric is coated with an adhesive, resinous or similar holding material solely along the projections, leaving the open weave porous for drainage of water. Because the back of the textile base carrier is only partly coated the openings in the base carrier remain open so that the water may pass through them. On the other hand the coating of the back insures that the textile base carrier can be made of relatively loose weave to which the pile is firmly tied. Preferably the projections extending in parallel relationship and the partial coating of the backside, forms drainage channels, so that even when it is laid out on a flat non-porous surface the water passing through the lawn may run off.

According to the present invention a novel underliner or underlayer is provided having enhanced resiliency and improved porosity. The underline is made from a grid of foam ribbon or yarn like material, coated with a plastic which is allowed to drip off in its wet state, forming tear drop projections on the undersurface.

Also according to the present invention an improved method and apparatus for securing the lawn to the ground is provided comprising channel members having claws or barbs for gripping the underliner, and/or the base carrier including right angle corners and means for pressing the fabric against the barbs.

Full details of the present invention are set forth in the following description and in the attached drawings.

DESCRIPTION OF THE INVENTION

Figure 1:
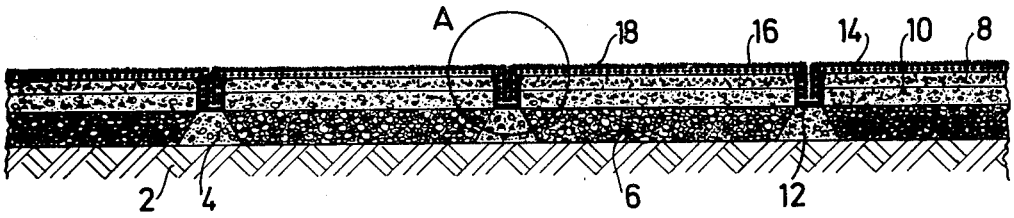
FIG. 1 is a cross sectional view of the lawn and its substructure, in accordance with the present invention.

A general schematic view of an assembled playing field is seen in FIG. 1. The artificial lawn, according to the invention, is seen lying on a suitably flattened, solidified earth ground 2 on which a plurality of conically tapering concrete ribs 4 are placed. The concrete ribs 4 are spaced parallel to each other at generally predefined intervals and have a drainage bed built between and above them. Such a bed may as shown, comprise a lowermost layer 6 of coarse pebbles filled to the top of the concrete ribs, covered by successive layers 8 and 10 of varying degrees of granulate or particulate particles of sand, stone, rubber, plastic or other drainage filler material. Fastening rails 12 are mounted by suitable bolts, nails, screws, etc. on the upper ridges of the concrete ribs 4. An underliner of cushion 14 lies on the top side of the upper drainage layer 8, over which the artificial lawn of the present invention is located. The lawn comprises a textile base carrier 16 to which a pile 18 forming a turf surface is anchored. Carrier 16, pile 18 and, optionally, the underliner 14 are held in the fastening rails 12 as will be hereinafter described.

A lawn of the type shown in FIG. 1 when employed on a soccer, football or baseball field, insures that, regardless of the weather, a turf capable of being played on is always provided. There is no narrow limit to the period during which the turf may be used as is the case with a natural lawn, but it may be played on practically continuously. The layer of pebbles 6 is provided between the concrete ribs 4 so that the field may be drained by a ring or peripheral drainage system not shown. If the earth 2, on the other hand, is loose and absorbent, the concrete ribs 4 could be recessed in the soil, and the drainage layers 8, 10 could be layed directly on the soil surface.

Figure 2:
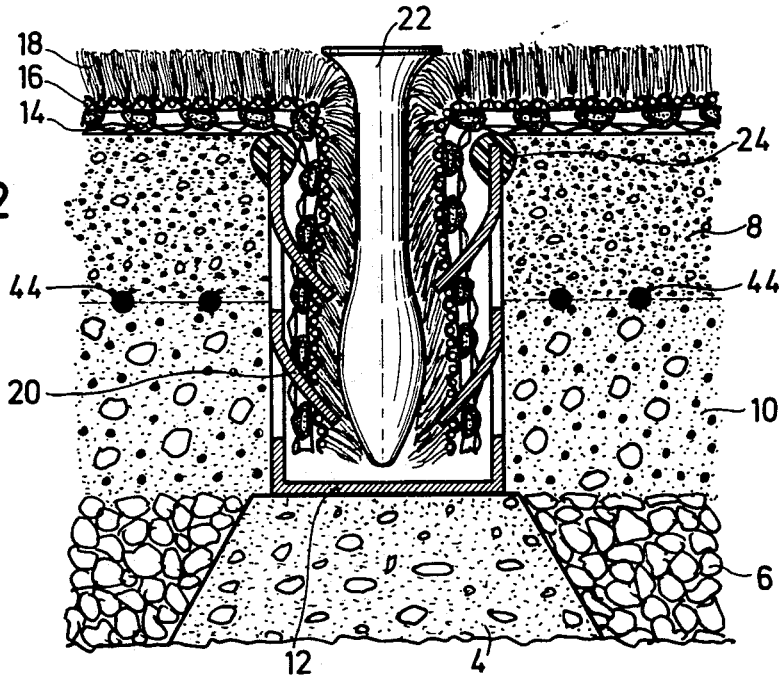
FIG. 2 is an enlarged fragment of FIG. 1.
Figure 3:
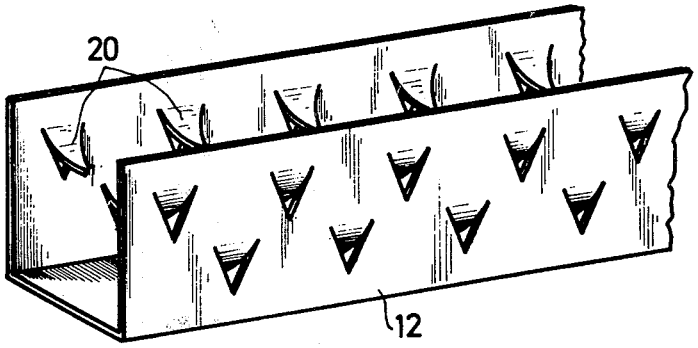
FIG. 3 is a view of a fastening rail.

With reference to FIG. 2 the details of the lawn anchorage is seen in a segment of the cross section of FIG. 1 depicted in the area marked by the circle A. The fastening rail 12 is formed in the shape of a U-channel, open in the upward direction, the interior of which is provided with pointed claws or barbs 20 which are directed obliquely downward. The barbs 20 are formed by triangular punched out portions of the rail wall as is best seen in FIG. 3, although other means such as nails, hooks etc. may also be substituted for the barbs. The punched barbs 20, however, provide drainage openings for water entering into the open end of the channel from above, permitting water to leave the channel rail 12 in a lateral direction.

The base carrier 16 on which the pile 18 is secured and the underliner 14, if desired, are hooked into the claw like barbs 20 in such a manner that the lawn can be securely anchored to the ground in a tensioned condition. In order to insure that the anchorage provided in this manner is perfectly secure and that the lawn will not loosen a safety element 22 is provided which may be wood, plastic or metal to fill the space remaining in the channel 12 after hooking of the lawn on the barbs. The safety element may be elongated to conform to the length of the rail, in any event it should be bulbous in cross-section to provide the degree of compression necessary for securing the lawn to the barbs 20. The safety element 22 forces the lawn substructure and/or underliner into the barbs 20, preventing the lawn from sliding off the barbs 20 and thus shifting when used. The safety element may be flared at its upper end, flattened and colored, thereby simultaneously serve as field markers, particularly at the periphery of the playing field. It may be provided with an axial socket in which a marker pole may be inserted. The safety element 22 may also be shortened, to be buried beneath, and thus covered by the pile 18, completely hiding these elements from view, if desired.

In order to prevent damage to the underliner 14 as it bends about the sharp upper edges of the fastening rail 12, the latter may be provided with rounded protectors 24 which, for example, may consist of resiliently yielding plastic or comparable material.

Figure 4:
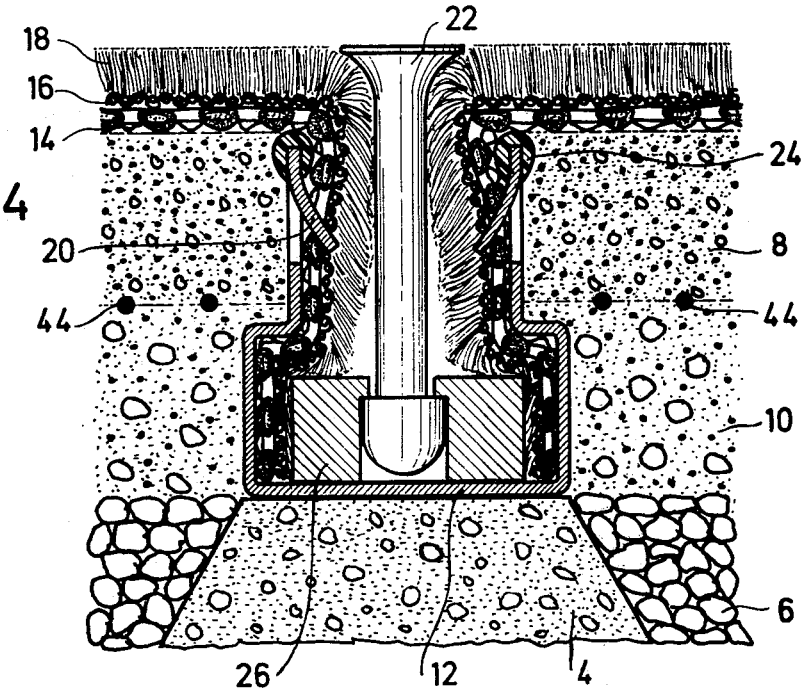
FIG. 4 is a view of a segment similar to FIG. 2 showing a further embodiment of the fastening rail.

An other embodiment of the fastening rail is shown in FIG. 4. In this embodiment the rail corresponds to that seen in FIG. 2 in that it is also an upwardly open U-channel, but it differs in that it has offset side walls and an enlarged lower portion. In this fastening rail the underliner 14 and lawn 16,18 are first also hooked over barbs 20, but thereafter, rectangular clamping rails 26 are placed within the channel and pressed by suitably shaped safety elements 22 outwardly against the side walls of the enlarged lower portion of the fastening rail. This embodiment enables the fastening of end pieces of the lawn 16,18 or of the underlayer 14 and may be used to join two sections of turf together. The firmness of the anchorage of each of such end is enhanced by the fact that the artificial lawn is secured three times through an angle of 90° as it folds about the internal corners of the retaining rail. The clamping rails 26 and the safety element 22 may be provided with interengaging lips facilitating their joint insertion or removal.

Figure 5:
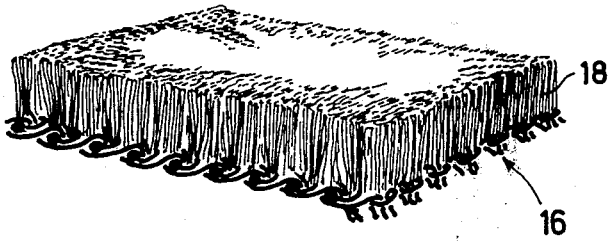
FIG. 5 is a perspective view of a section of the artificial lawn according to the invention, as viewed from above.
Figure 6:
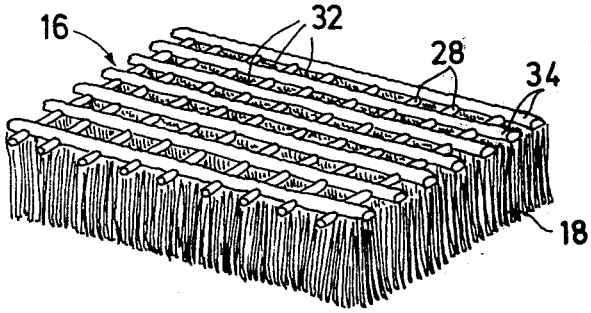
FIG. 6 is a perspective view of a section of artificial lawn according to the invention, as viewed from below.
Figure 7:
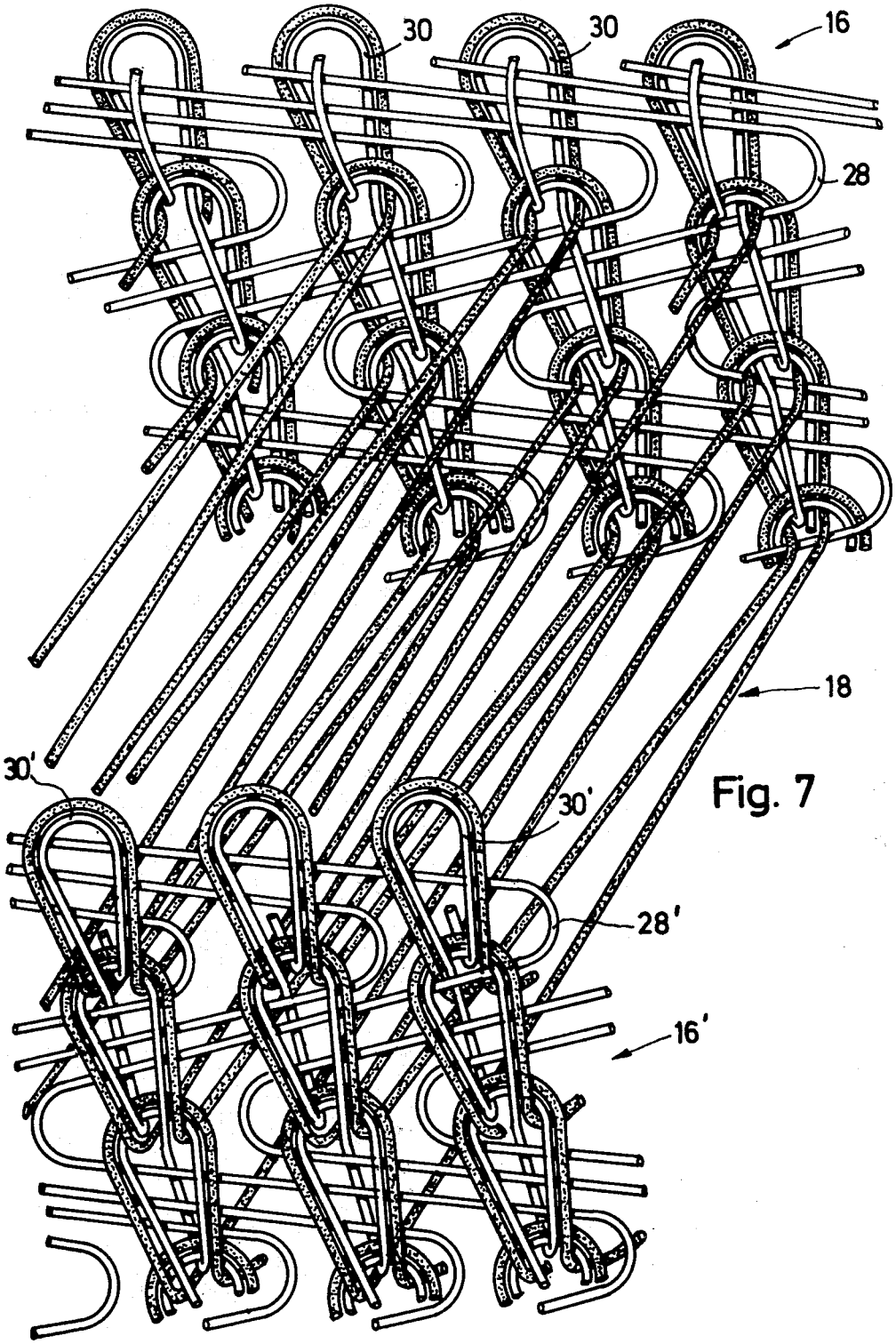
FIGS. 7 and 8 show detail of the structure and method of forming base carrier and the pile of the artificial lawn.
Figure 8:
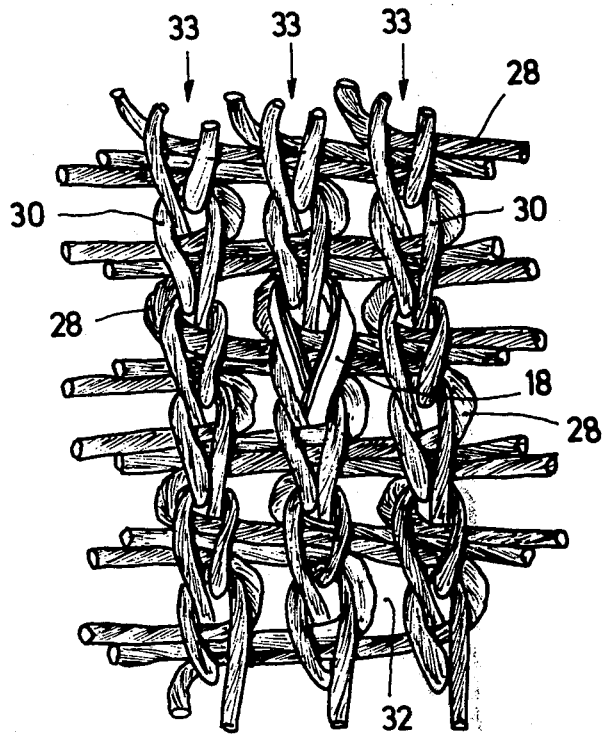

FIGS. 5 and 6 are respectively top and bottom perspective views of a section of lawn. The design and formation of the lawn of the invention shall be explained in detail with reference to FIGS. 7 and 8. FIG. 7 shows a highly enlarged section of a Raschel knitted textile material in perspective view as it is obtained from a two-bed flat knitting machine of the Raschel type. In such a machine, two layers of the lawn of the invention are simultaneously prepared, the textile base material in FIG. 7 is designated by reference numeral 16,16′, whereas the pile 18 connecting the two base layers is common to both. The pile-forming thread which is preferrably a strong plastic tape or ribbon, is emphasized by showing it in dotted shading while the thread forming the base structure 16,16′ are shown without shading. The threads of the base structure are knit on the machine in a conventional manner to form what appears as a generally loose or open box like woven structure having crossing wefts 28,28′ and warps 30,30′. The pile 18 is interlocked with the weft 28,28′ as seen clearly in FIG. 6. Although not so indicated in FIG. 7 or 8, the weft yarns 28,28′ should be substantially stronger or of larger diameter than the warp yarns 30,30′ since they cooperate with the heavy pile tape to produce the reenforced structure illustrated in FIG. 6 and to form enlarged projections as will be explained later. After knitting the lawn in the conventional manner on the machine, the pile 18, between the base carriers 16 and 16′ is cut so that two separate layers of the lawn are formed. Such a layer is shown, in bottom view, in FIG. 8, in which the pile for simplicity of representation is omitted with the exception of one loop 18, which loop, shows its securement to the base, and permits the flat tape shape of the pile to be seen clearly. The base carriers 16,16′ are loosely knit so that relatively large openings 32 are formed between the grid of the weft in the base carrier 16. Well defined ridges 33 are also formed on the underside of the base by use of a strong weft yarn 28 and a strong pile 18 in combination with weaker warp 30.

The back of the base carrier 16, formed as described above, is then coated with a suitable adhesive or plastic material, in such a manner that only the ridges 33 (and perhaps also the weft 28) are coated to stabilize a grid-like structure. The openings 32 are left uncoated and thus open to the passage of water. The ribs formed by the coated ridges 33 have been indicated in FIG. 6 by reference numerals 34, whereas the coated weft continues to carry numeral 28 as in the other Figures.

Figure 10:
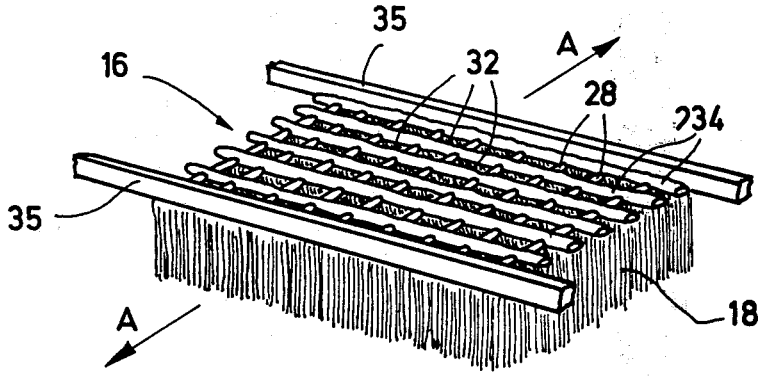
FIG. 10 is a view corresponding to that of FIG. 6 which shows the preparation of the coating on the backside of the piece of lawn.

The coating material which is preferably soft polyvinyl chloride, can be applied by means of a simple roller, because of the well defined back surface structure of base carrier 16,16'. If openings 32 should be plugged, for example, because of the flowing ability of the freshly applied coating material, it is only necessary to pull the textile carrier apart transversely to the ridges 33 or ribs 34, preferably at the time when the coating material starts to solidify to open the spaces. A tension frame 35 may be employed for pulling the fabric apart as indicated in FIG. 10, the arrow A showing the direction of pulling. This procedure may be effected prior to the final curing of the textile or coating under applied heat.

When the back of the artificial lawn of the invention is viewed as in FIG. 6, it is seen that channels are formed between the coated ribs 34. The ribs 34 are generally parallel to each other and thus the channels form longitudinal troughs for the collection and run off of water. While the cross sectional area of the ribs 34 is reduced at certain intervals by the weft 28, the ability of the channels to serve as a water run-off is not significantly impaired. It is further seen that the water entering from the surface of the pile can pass practically unimpeded through the uncoated openings 32 of the basic carrier. It is thereby insured that any water on the surface of the artificial lawn, not only reaches the underside of the basic carrier, but is also readily released through the channels into the soil bed. This will occur even if the lawn should lie atop an impermeable ground surface, as long as the lawn is layed out with a sufficient inclination to permit the water to flow through the channels.

Figure 9:
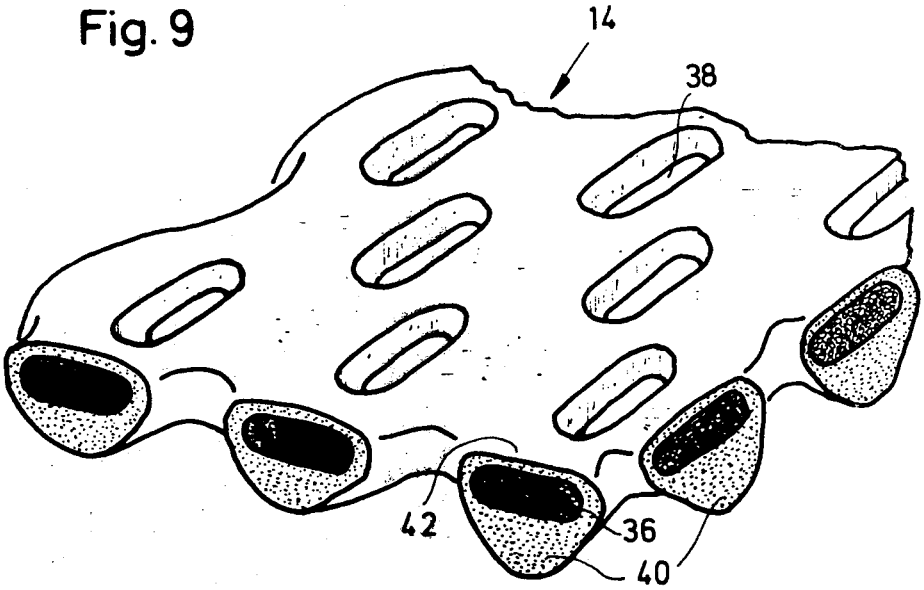
FIG. 9 is a perspective view of an underline for the artificial lawn.

FIG. 9 is a top perspective view of an underliner or cushion 14 for use with a lawn of the present invention. The underliner 14 consists in the illustrated example of core 36 of foamed material, perhaps of plastic or rubber in the form of a commercial grid-like, so-called anti slip mat. The foam core is provided with apertures 38 which extend between the two principal surfaces, i.e. between the top side and the under side, of the mat. In order to prepare the underliner 14, the perforated plastic or foam plastic mat, is dipped into a mass of soft plasticized PVC whose viscosity is selected in such a manner that the mat of the foam material is initially fully coated with the soft PVC. After the withdrawal of the mat, a surplus of PVC material collects on its bottom side and there solidifies to form tear drop-shaped projections 40. The other parts of the foam material mat, particularly its upper surface are nevertheless coated with a uniform, relatively thin layer of PVC, 42 and thus the entire mat is made water-impermeable.

The tear drop-shaped projections on the underside make the underliner particularly suitable for use with the aforedescribed artificial lawn since water passing through the lawn and guided in the channels between the ribs 34 can then easily pass through the openings 38 on to the top of the drainage layer 8,10. The space between the liner 14 and the top of the drainage layers 8,10 is enlarged by the point-shaped contact of the tear drops 40 and is sufficiently great, to permit safe and quick absorption and runoff even of large amounts of water, particularly when a suitable inclination of the subsoil is provided. The underliner 14, because of its shape, increases the resiliency of the lawn, and its cushioning effect, even though it consists only partly of foam material. Because of its water-proof coating, moisture or water can not be absorbed by it to remain on the underside of the lawn. This is particularly important when there is danger of freezing and the probability of ice formation. The fact, that ice formation, directly below the playing surface is prevented by the underliner of the present invention, is particularly valuable in a variable temperate or northern climate such as, for example, in Germany and the U.S. As is well known, in such areas the temperature may vary several times a day above and below the freezing point during the winter months. Consequently, when ordinary foam liners are used, the underground saturated with water during a period of thaw, remains moist and solidifies in a subsequent freezing period, impairing not only the elasticity of the artificial lawn, but rendering the playing field hazardous to the possible serious injury of the players. With the underliner 14 of the invention, no water can enter the coated foam plastic mat, so that the latter retains its elasticity and is not exposed to the danger of destruction as may have been the case when ordinary mats had been used.

A further improvement in the positive properties of the lawn of the present invention is achieved, when the underliner 14 is supported by an absorbent drainage bed, as is shown in FIGS. 1, 2, and 4. A drainage bed has been found particularly advantageous which consists of an upper layer 8 and a lower layer 10 which differ essentially by their grain size and the amount and the quantative relationship of their components. Preferrably, the upper layer of the drainage bed according to the invention, might consist of relatively fine pebbles, Bitumenous particles and relatively large amounts of rubber granulate, hardenable plastic and hardening or binder material. This layer not only has a certain elasticity which is necessary to imitate the properties of a natural lawn, but also permits the players to play in their accustomed manner. It also allows the behaviour of the playing ball to correspond to that on a natural lawn. Moreover, it is water=permeable. Because of its content of pebbles and rubber granulate material, cavities are formed, through which the water can run off. Moreover, the material for such a bed is relatively inexpensive, because rubber granulate can be made from regenerated old car tires, etc. and is cheap raw material. It has also been found that particularly good results are achieved with square or rectangular rubber pieces and polyurethane similarly formed. It has also been found useful to adhere, or permit the adhesive fastening of the underlayer 14 at their individual tear drop points with the hardened rubber or plastic material of the drainage layer. This reduces transverse load on the fastening members or rails 12 and absorbs the stress and tension given the lawn when played on. It has been, furthermore, found that the drainage bed of the described composition is suitable to receive heating elements 44 by means of which the run-off of molten ice and water can be accelerated and the surface rendered more resilient to use. It has been found particularly advantageous when cableshaped heating elements are employed, which are layed in previously formed grooves approximately in the middle between the drainage layer 8,10 or in grooves which are prepared by means of a preformed patterned matrix using a grid-shaped profile. When the heating element is embedded in the drainage layer in this manner, practically all of the heat generated will quickly reach the playing surface and not as in previously known systems which are heated by ground level devices, be dissappated by substantially heating the air. The advantages of the present mode of heating may be compared to the mode disclosed in German Patent 1534384.

The lower layer 10 of the drainage bed is built up in the same manner as upper layer 8, however, it contains coarser pebbles and less rubber granulate. This layer can be located directly on the underground or earthen bed if the soil is permeable, or, if the soil is impermeable, a layer of pebbles may be interposed therebetween as seen in FIG. 1. It will be understood that the selection of a drainage system may be chosen by those skilled in this art as can the selection of heating elements. Electrical cable heating means is, however, preferred.

The structure, according to the present invention, is not limited to this specific form shown but may be achieved in the most simple manner by selecting a textile base carrier having two yarn systems to which the pile is intimately tied. One yarn system consists of substantially thinner yarns than the other and are loosely woven or knit forming interstices or openings between the courses. By this measure the basic carrier is provided on its underside with projecting structures forming at least approximately parallel ribs which define horizontal drainage channels as well as transverse holes. The ribs further permit the base carrier and pile turf to be strengthened and permanently reinforced by coating them with a resinous, plastic material impervious to water, mildew, etc. without impairing the porosity and permeability of the spaces between course.

The adhesive binder may be applied by brush, roll coating, or similar techniques. If an excess of binder is applied, the spaces between courses can be easily opened by stretching or by pulling the base carrier after the binder starts setting or gelling.

It has been found that the lawn is most simply prepared and has the greatest advantages when produced as a Raschel-knitted textile. It is particularly economical to make two layers of a base carrier simultaneously on a two-bed flat knitting machine of the Raschel type and connect a common pile, which is later cut apart. In such a textile material strong loops of pile can be anchored to one of the yarns so that it increases the rib structure on the underside of the carrier. The pile is thus firmly anchored in spite of only a partial coating of the backside.

Suitable material for the pile of the lawn of the present invention can be chosen from such plastics as polypropelene and nylon whereas the material for the basic carrier may be the same or a polyester. The coating may be polyvinyl chloride dispersions or other suitable substitutes.

Although, as mentioned above, the lawn according to the present invention provides drainage troughs or channels on its underside suitable to permit flow of the water even on a water-impermeable smooth ground and thus can be used alone, it has been found advantageous to provide a water-permeable resilient drainage underliner of the present invention. The grid-like or web mat, of foamed material, is capable of being heated or immersed in a hot bath. The mat is itself coated with a water impermeable barrier or outer layer, permits the free flow of water through a large number of openings. The liner also is not absorbent and thus does not retain moisture. The liner furthermore has enhanced cushioning because of the tear drop or point-like projections which are also capable of adhesion to the drainage beds reducing the possibility of sliding or dislodgement under use.

Another advantage of the present invention is obtained through the use of a drainage bed having a high proportion (30-60% or more) of granulate and particulate rubber, plastic Bitumenous material. Such a drainage bed is highly porous, substantially resilient to the foot and thus quite similar to good natural ground. Moreover, such a bed in combination with the aforementioned underliner, prevents sliding of the lawn, the base carrier, or other substructure, thereby releasing lateral or transverse stresses in the anchorage of the lawn proper. The underliner can otherwise be of a very firm structure, such as the conventional anti-skid mats of foam material and carpet cushions which are a staple article of commerce.

It is preferred to make a composition of the underlying drainage beds consisting of pebbles, Bitumen, rubber and optionally of hardenable plastic and/or binder. The grain size of the pebbles should increase towards the bottom. One or more distinct laminae may be used for the beds, which may be layed directly on the ground, on a bed of coarse stone or rocks or may even be omitted if the sub-soil ground is sufficiently soft and porous itself. The drainage beds may be used with or without the cushion underliner.

Further advantages have been obtained from the novel structure of retaining rails in which both end pieces and continuous pieces of lawn may be anchored in stretched condition. The rails are made with openings at each end as well as lateral openings, allowing the water to flow outward freely. The rails may be easily secured to the ground, concrete ribs, or other substructure and should not be filled except with the lawn and retaining members.

It is to be pointed out that the materials mentioned for the individual components of the artificial lawn of the invention and its understructure, are only to be considered as preferred examples. They may be replaced by other materials having corresponding properties. It is further to be understood that the quality of the surface and base carrier of the artificial lawn of the invention may also be left to the expert who may have a field of free selection beyond that of the described preferred embodiments, as long as care is taken that a safe run-off of the penetrating water is provided. Various fastening means other than that disclosed may be used with the lawn, providing a safe anchorage of the lawn is obtained. Instead of concrete ribs for supporting the fastening rails, steel bars or alike may be employed. It is also possible to connect the fastening rails for example, at individual points only by suitable anchors with the soil underground base. Moreover, transverse ribs located between the heretofore described ribs, have been found useful as additional support, particularly in large playing fields, and may also carry fastening rails. In this manner the playing field may be divided into individually tensioned zones of turf.

What is claimed:

1. An artificial lawn adapted to be laid on the ground comprising a textile base carrier and a pile affixed thereto forming a turf surface, the yarns of said carrier and said pile being intermeshed with each other to provide structures projecting from the plane of the back side of said carrier and interstices therebetween, the intermeshed yarns of said carrier and said pile being securely adhered together by a coating applied substantially only to said projecting structures, whereby transverse openings through said carrier and horizontal drainage channels are provided along the back side of said carrier.

2. The ground cover according to claim 1, wherein said projecting structures are aligned to form ribs substantially parallel to each other.

3. Lawn according to claim 1, characterized in that the textile carrier has two systems of yarns, and a pile yarn connected to one system, one of the yarn systems being formed of a substantially thinner yarn than the other yarn system and of the pile yarn.

4. The lawn according to claim 1, characterized in that it comprises a Raschel-knitted textile material.

5. The lawn according to claim 1, characterized in that the warp of the Raschel material consists of thinner yarn than the weft and pile.

6. The lawn according to claim 1, wherein the coating comprises polyvinylchloride.

7. The lawn according to claim 1 including a water-permeable underliner of elastic material interposed between the ground and the base carrier.

8. The lawn according to claim 7, wherein the underliner comprises a net-like structure built up by cushion-like portions adapted to rest on the surface of the ground.

9. The lawn according to claim 8, wherein the underliner comprises a grid formed of a material of high tensile strength, said grid being provided with an elastic, water-impermeable coating applied thereto and providing droplike projecting structures on the underside of said underliner.

10. The lawn according to claim 9, wherein the coating consists of soft plasticized polyvinylchloride.

11. An artificial structure adapted to be laid on the ground comprising a porous carrier having a turf-like top surface and a water permeable cushion comprising an integrated net-like grid formed of a material of high tensile strength, said grid being provided with an elastic water impermeable coating applied thereto and providing drop-like projecting structure on the underside of said cushion members between its bottom and the ground.

12. The cover according to claim 11, wherein the coating consists of soft plasticized polyvinylchloride.

13. An artificial structure adapted to be laid on the ground comprising a porous base mat having a backing of coated woven or knitted textile provided with a plurality of impermeable drop-like cushion members arranged in a network between its rear surface and the ground, said cushion members being spaced from each other to permit vertical drainage of water through said base mat and horizontal drainage of water over said ground.

14. The structure according to claim 13, wherein said drop-like members are interconnected in an integrated network of resilient material.

15. An artificial structure adapted to be laid on the ground comprising an open grid base mat formed of a material of high tensile strength, providing vertical drainage for water, said grid being provided with an elastic water impermeable coating applied thereto in an integrated network and providing a discrete drop-like projecting structure on the underside of said underliner forming said cushion members, said drop-like members being spaced from each other to permit horizontal drainage of water over said ground.

16. The structure according to claim 15, wherein the coating consists of soft plasticized polyvinylchloride.

17. The structure according to claim 16, wherein the base mat is perforated and said projections are spaced from each other to permit vertical drainage therethrough.

18. The underliner for ground covers, mats, and the like comprising a flexible pile base having a substantially planar upper surface and formed of a vertically porous resilient core of high tensile strength, said core being provided with an elastic water impermeable coating applied thereto and providing projecting structures extending from the lower surface forming a network of spaces between the base and the ground.

19. The undersliner according to claim 18 wherein said core comprises an open grid having apertures therein from one surface to the other and said projecting structures are spaced from said apertures.

20. The underliner according to claim 18 wherein said core comprises a sheet of foamed material and apertures are formed through said sheet and the coating between said projecting structures.

21. The underliner according to claim 18, wherein said base is made from filaments of heat resistant, resilient synthetic materials.

22. A ground cover such as a mat, carpet, or the like, comprising a textile base carrier having a pile tread surface formed of filaments interconnected to provide interstices therebetween and projecting structures on the backside thereof, substantially only said projecting structures being coated with an adhesive material whereby transverse openings and horizontal drainage channels are provided.

* * * * *